United States Patent [19]

Clinton

[11] 4,319,420

[45] Mar. 16, 1982

[54] CANVAS FRAME SPRING TENSION WIRE CLAMP APPARATUS

[76] Inventor: Robert E. Clinton, 6403 S. 5th Ave., Phoenix, Ariz. 85041

[21] Appl. No.: 223,250

[22] Filed: Jan. 8, 1981

[51] Int. Cl.[3] ..... G09F 1/12

[52] U.S. Cl. ..... 40/156; 40/10 R; 52/475

[58] Field of Search ..... 40/152, 152.1, 10 R, 40/156; 52/475

[56] References Cited

U.S. PATENT DOCUMENTS

| | | | |
|---|---|---|---|
| 481,117 | 8/1892 | Naegele | 40/156 |
| 509,626 | 11/1893 | Patterson | 40/156 |
| 908,608 | 1/1909 | Pullen | 40/156 |
| 1,066,495 | 7/1913 | Helvig et al. | 40/156 |
| 1,851,201 | 3/1932 | NcLoughlin | 52/475 |
| 2,820,311 | 1/1958 | Hamlin | 40/156 |
| 3,899,844 | 8/1975 | Munn | 40/156 |

*Primary Examiner*—Gene Mancene
*Assistant Examiner*—Wenceslao J. Contreras
*Attorney, Agent, or Firm*—H. Gordon Shields

[57] ABSTRACT

Spring tension wire clamp apparatus includes a screw adapted to extend into a wooden frame with a spacer between the frame and a clamp which extends outwardly from the screw and adapted to be disposed against a canvas frame for holding the canvas frame into the picture frame.

10 Claims, 7 Drawing Figures

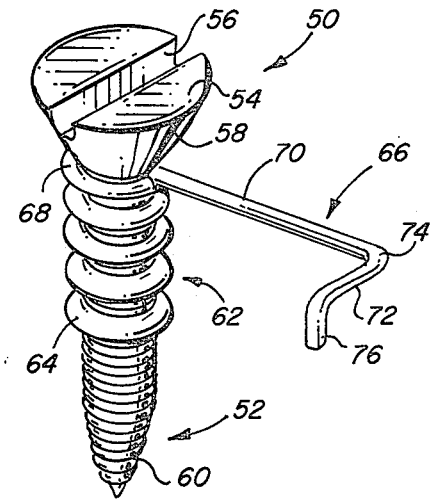
FIG. 1
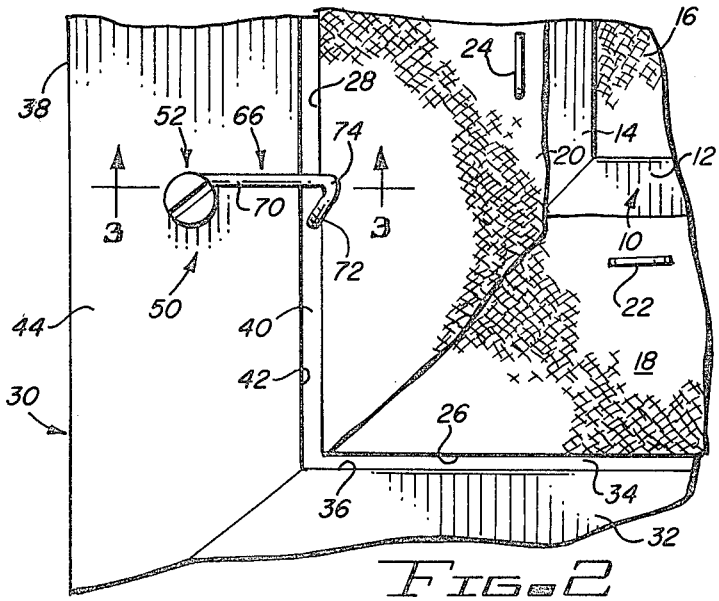
FIG. 2
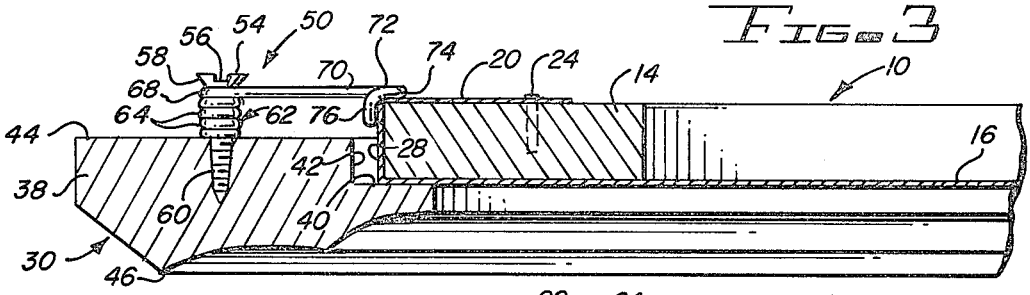
FIG. 3
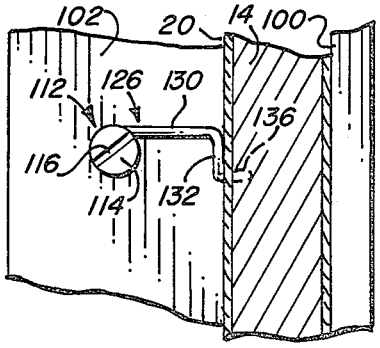
FIG. 7
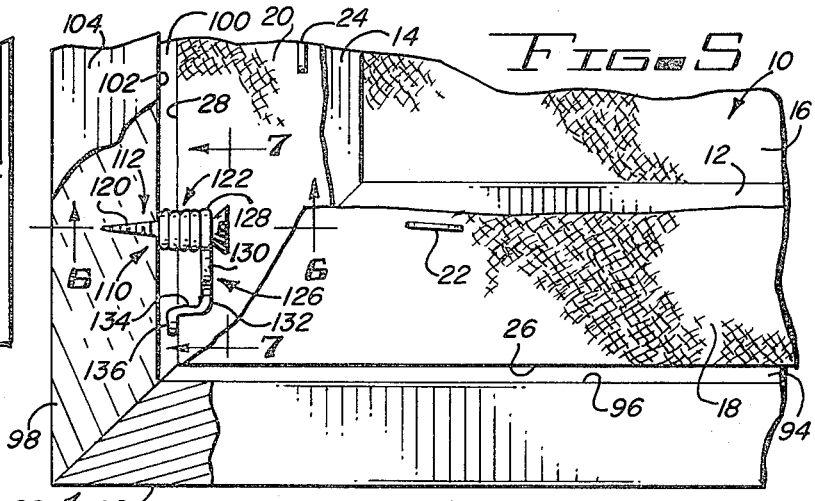
FIG. 5
FIG. 4
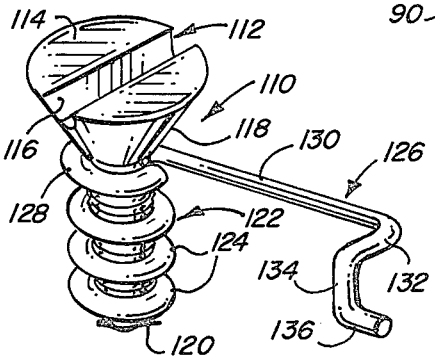
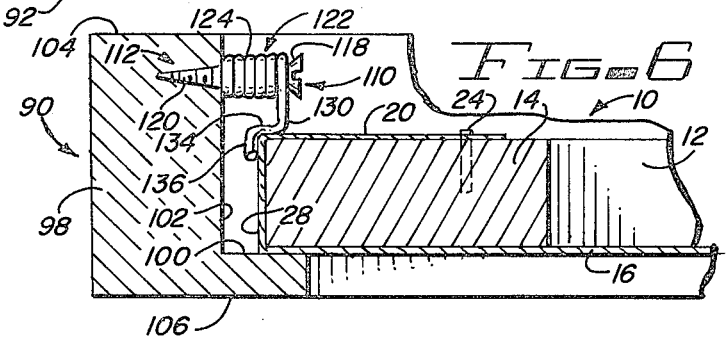
FIG. 6

CANVAS FRAME SPRING TENSION WIRE CLAMP APPARATUS

BACKGROUND OF THE INVENTION

1. Field of the Invention

This invention relates to picture frames, and more particularly, to clamps for securing a stretched canvas frame into a picture frame for framing the stretched canvas.

2. Description of the Prior Art

In the general field of art, pictures are painted on stretched canvas secured to a stretcher, which simply comprises a frame on which the canvas is stretched and to which the canvas is secured. When the artist completes the picture on the stretched canvas, and after the paint has dried sufficiently, the picture and the stretched canvas and its stretcher frame, is secured to a picture frame. In the prior art, the most common way of securing the two frames together is simply by nailing the canvas frame to the picture frame. This is usually done by driving a nail at an angle into the picture frame, with the nail disposed on or against the canvas frame. Usually four nails are used to hold the canvas frame into the picture frame, namely one nail on each of the four sides of the picture. If the canvas frame is oval or round, rather than square or rectangular, the four nails may be located as desired. Under some circumstances, perhaps only three nails may be necessary. Under other circumstances, more than four nails may be required.

There are obvious problems with using nails, such as the possibility of splitting the picture frame, tearing the canvas frame, scratching the wall against which the picture is hung, etc. The problems, which perhaps seem relatively small and insignificant, are yet relatively significant in terms of the potential damage and inconvenience which results from the use of the nails. The apparatus of the present invention, which utilizes a wire clamp, avoids the problems of the prior art and allows a stretched canvas frame to be secured conveniently and easily into a picture frame.

Another problem with the prior art is that often times the stretched canvas does not fit exactly into the picture frame, and the stretched canvas accordingly must be carefully positioned within the picture frame. It is often difficult to position a stretched canvas frame properly within a picture frame by use of the nails. The problem with the nails becomes more acute when the difference between the sizes of the two frames increases. For example, it may be necessary to move the stretched canvas frame in a particular manner or in a particular location with respect to the picture frame, which does not provide the greatest thickness of the picture frame available to a nail. When a nail is thus driven into the picture frame, the likelihood of damage, due to the splitting of the picture frame, is greatly enhanced. The apparatus of the present invention overcomes that problem by the inherent nature of the clamp which is adapted for virtually any size stretched canvas frames and picture frames.

U.S. Pat. No. 481,117 discloses a clip apparatus for securing a canvas stretcher frame to a decorative picture frame. The clip apparatus is unitary and it includes a screw portion which screws into the wooden or decorative frame, and a spring portion is connected directly to the screw portion, which biases downwardly against the stretcher frame in a direction substantially parallel to the threaded member. The biasing action is accordingly disposed in a single direction.

U.S. Pat. No. 2,698,470 discloses another type of apparatus for securing a stretcher frame to a decorative frame. The fastening apparatus is adapted to extend from one side, namely inside, of a stretcher frame, over the stretcher frame, around portions of three sides of the stretcher frame, and terminate against the inside of the decorativve frame. The fastening apparatus includes two points, one at each end, which are adapted to penetrate into the respective frames. The fastening apparatus is of a generally wide U-shaped configuration, with one of the arms of the U extending higher than the other arm.

U.S. Pat. No. 2,807,110 discloses another spring type clip for securing a canvas stretcher frame to a decorative frame. The element is a curved element with a pair of prongs at one end which are adapted to extend into the wooden decorative frame for holding purposes. The curved body portion is resilient and, with its spring force, holds the stretcher frame or picture in the decorative frame. The apparatus of the '110 patent is specifically designed for holding pictures into picture frames with a hook portion, which is disposed between the prongs, adapted to engage the backing of the picture.

U.S. Pat. No. 2,820,311 discloses a clamp for holding a stretcher frame into a decorative wooden frame. The apparatus includes a screw element and an elongated and resilient arm which extends over the stretcher frame. The screw is used to bias the arm against the stretcher frame.

It will be noted that all of the patents of the prior art are designed to provide a bias in a single direction for holding a stretcher frame into a decorative frame. However, such bias does not hold a canvas stretcher frame with respect to a picture frame when a bias is needed in two directions, as when the stretcher frame is not substantially the same dimensions as the appropriate or mating portion of the decorative picture frame. The apparatus of the present invention provides a bias in two directions between the canvas stretcher frame and the picture frame to allow for mismatched fits, including different sizes and out-of-square stretcher and/or picture frames.

U.S. Pat. No. 4,027,413, granted June 7, 1977, discloses a type of clip for securing a stretched canvas frame into a picture frame. The clip is of one-piece construction, and is not adaptable to stretch canvas frames of various sizes.

SUMMARY OF THE INVENTION

The invention described and claimed herein comprises a wood screw adapted to be secured into a picture frame, and a wire clamp extending outwardly from the wood screw and adapted to be positioned against the stretched canvas frame. A spacer is used for adapting the apparatus to virtually any size picture frame and stretch wire frame by taking up the space or the distance between the picture frame and the wire clamp.

Among the objects of the invention are the following:

To provide new and useful apparatus for securing a stretched canvas frame to a picture frame;

To provide new and useful clamp apparatus for securing a canvas frame to a picture frame;

To provide new and useful spring tension clamp apparatus for securing a stretched canvas frame to a picture frame; and To provide new and useful clamp apparatus secured through a wood screw to a picture frame and extending to a stretched canvas frame for securing the stretched canvas frame to the picture frame.

BRIEF DESCRIPTION OF THE DRAWING

FIG. 1 is a perspective view of the apparatus of the present invention.

FIG. 2 is a top view of the apparatus of the present invention, showing the apparatus secured to both a stretched canvas frame and to a picture frame.

FIG. 3 is a view in partial section of the apparatus of FIG. 2 taken generally along line 3—3 of FIG. 2.

FIG. 4 is a perspective view of an alternate embodiment of the apparatus of FIG. 1.

FIG. 5 is a top view of the apparatus of FIG. 4, illustrating the apparatus in a use environment.

FIG. 6 is a view in partial section of the apparatus of FIG. 5, taken generally along line 6—6 of FIG. 5.

FIG. 7 is a view in partial section of a portion of the apparatus of FIG. 5, taken generally along line 7—7 of FIG. 5.

DESCRIPTION OF THE PREFERRED EMBODIMENT

FIG. 1 comprises a perspective view of clamp apparatus 50 of the present invention. FIG. 2 is a top view of the clamp apparatus 50 of the present invention illustrated in its use environment. FIG. 3 is a view in partial section of the apparatus of FIG. 2, taken generally along line 3—3 of FIG. 2. For the following discussion, reference will be made to FIGS. 1, 2, and 3.

The clamp apparatus 50 comprises a canvas frame spring tension wire clamp for securing a canvas stretcher frame 10 to a decorative picture frame 30. The canvas stretcher frame 10 and the decorative frame 30 are generally well known and understood in the art. The stretcher frame 10 comprises a wooden frame having four sides or arms over which canvas 16 is stretched, and to which the canvas is appropriately secured. Two of the sides or arms 12 and 14 are shown in FIGS. 2 and 3. It will be noted that for convenience, only a portion, namely a corner portion, of the stretcher frame 10 is shown in FIGS. 2 and 3. Two adjacent arms 12 and 14, with canvas 16 secured to the arms of the frame 10, are shown disposed against two adjacent arms 32 and 38 of the decorative or outer frame 30. As is well known and understood, the adjacent arms of both frames have mitered corners.

The canvas 16 is stretched on the frame and held and secured to the frame to hold the canvas taut for purposes of painting on the canvas. As illustrated in FIGS. 2 and 3, the canvas 16 extends across the front of the frame and around the outer periphery of the frame 10, and is folded and stapled to the back of the frame 10. The pair of rear, folded portions 18 and 20 are illustrated in FIG. 2 as stretched over the arms 12 and 14, respectively, and secured to the arms 12 and 14 by staples 22 and 24, respectively. The outer periphery of the stretcher frame 10 includes outer sides 26 and 28, respectively, of the arms 12 and 14, over which the canvas 16 is stretched.

The portion of the decorative picture frame 30 in which the stretcher frame 10 is disposed includes the pair of arms 32 and 38, appropriately mitered and secured together. The arms 32 and 38 include a pair of rabbets on their inner periphery. The rabbets, or grooves or relieved portions, include or define a flange 34 and a side 36 in the arm 32, and a flange 40 and a side 42 in the arm 38. The outer peripheral portion of the stretcher frame arms 12 and 14 is shown in FIGS. 2 and 3 as being disposed on the flanges 34 and 40, with the sides 26 and 28 spaced apart from the sides 36 and 42 of the arms 32 and 38, respectively.

As is obvious, and well known and understood, each of the four arms which comprise the frame 30 includes the inner groove or relieved portions on which the stretcher frame is disposed. As is also well known and understood in the art, it is seldom that the stretcher frame and grooved or relieved portion of the decorative frame in which the stretcher frame is to be installed are dimensioned for a relatively tight fit. As is more often the case, and as is illustrated in FIGS. 2 and 3, there is a space or gap between the sides of the grooves and the outer edges of the strecher frame and canvas.

Each of the arms 32 and 38 of the decorative picture frame 30 include generally flat, or planar, surfaces. A flat, planar back surface 44 is illustrated in conjunction with the arm 38, and the clamp apparatus 50 is shown in FIGS. 2 and 3 as being used in conjunction with the surface 44 of the arm 38 to secure the stretcher frame 10 to the frame 30. The back or rear surface 44 is at the rear of the frame 30, and spaced apart from a front surface 46 of the frame 30. The front surface 46 is illustrated as being somewhat irregular, as is typical for decorative frames.

For securing the stretcher frame 10 to the frame 30, the clamp apparatus 50 of the present invention is used.

The clamp apparatus 50, as best shown in FIG. 1, includes three elements, a screw 52, a spacer 62, and a clip 66. The screw 52, illustrated herein, comprises a flat headed wood screw, and includes a head 54 which is generally flat or planar across the top. The head 54 includes a slot 56 which extends downwardly from the flat top of the head 54 and which receives the blade of a screwdriver. Extending inwardly and downwardly from the outer periphery of the head 54 is a sloping shoulder 58. A threaded shank 60 extends downwardly from the inner periphery of the shoulder. The threaded shank 60 tapers to a point at the bottom of the screw, remote from the head 54.

The second element involved in the clamp 50 is a spacer 62. The spacer 62 comprises a plurality of helical coils of wire disposed about the threaded shank 60 of the screw 52. The coils 64 are spaced apart slightly from each other. The purpose of the spacer will be discussed below in conjunction with the installation and use of the clamp apparatus 50.

Disposed above the spacer 62, and below the head 54, and generally against the sloping shoulder 58 of the screw 52 is a clip 66. The clip 66 is preferably made of wire, as is the spacer 62. The clip 66 is a single or unitary length of wire which includes a circular eye portion 68 extending around the shank of the screw 52 between the uppermost of the coils 64 of the spacer 62 and the head 54 of the screw 52.

Extending generally outwardly from the circular eye 68 is an upper or extension arm 70. The arm 70 extends outwardly from the screw 52. At the outer end of the arm 70, remote from the eye 68, is a top or intermediate arm 72. As best shown in FIG. 2, the arm 72 is disposed at an acute angle with respect to the arm or extension 66. That is, the included angle between the arms 66 and 72 is less than 90°. A bend 74 is defined at the juncture of the two arms 66 and 72. As shown in both FIGS. 2 and 3, the bend or juncture 74, a portion of the arm 70, and substantially the entire length of the arm 72, is disposed on the canvas fold 20 and accordingly on the stretcher frame 10.

Extending downwardly from the end of the arm 72 remote from the bend 74 is a side arm 76. The side arm 76 extends substantially perpendicularly to the top arm 72, to which it is secured, and also substantially perpendicularly to the extension arm 70. The arm 76 is disposed against the outer periphery or side 28 of the stretcher frame 10, as best shown in FIG. 3.

As may be understood, several, perhaps four or more, clamps 50 may be used to secure a stretcher frame in and to a decorative picture frame 30. The clamps 50 are preferably disposed on all four sides of the stretcher frame. The arm 76, disposed against the side of the stretcher frame, provides an inward or lateral bias against the stretcher frame, with respect to the decorative frame 30, and the arms 70 and 72 provide a downward bias, to urge the stretcher frame 10 against the frame 30. The term "down" refers herein to the urging of the stretcher frame 10 against the decorative frame, and most particularly against the flange 40, as shown in FIG. 3 of the frame 30. The terms "inward" or "lateral" as used herein refer to the urging of the stretcher frame parallel to the flange 40, and towards the center of the frame 30, or, in other words, in a direction substantially perpendicular to the "downward" direction against the decorative frame. The downward direction is towards or against the decorative frame, while the inward or lateral direction is along the decorative frame.

In practice, or in a use condition of the clamp apparatus 50, the stretcher frame 10 is first oriented with respect to the frame 30, and the clamp apparatus 50 is located with respect to the stretcher frame 10 on the frame 30. As indicated above, it may be preferable to use more than one clamp 50. However, the actual number of clamps 50 used to secure a stretcher frame 10 to a decorative frame 30 depends on the fit between any particular stretcher frame and decorative frame. Once the stretcher frame is oriented, as desired, a tool, such as an auger, ice pick, awl, etc., may be used to make a starting hole in the surface 44 of the frame 30 to receive the threaded shank 60 of the screw 52. The screw 52 is then secured to the frame 30.

The spacer 62 is used to provide appropriate spacing between the top surface 44 of the back of the frame 30 and the circular eye 62 of the clamp 50. The spacer 62 thus comprises a shim, which is variable in size or height, to provide the appropriate spacing.

The spacer 62 comprises a plurality of coils spaced apart and helically extending about the shank of the screw 62. The spacer 62 is preferably made of appropriate material in order that it may be stretched or opened wider to spread the individual coils, or collapsed, to compress the space between the individual coils, as desired to provide the appropriate spacing. Moreover, the overall length (height) of the spacer 62 may be decreased by cutting off an appropriate or desired length of the spacer, if needed.

The spacer provides the appropriate bias against the clip 66 to urge the eye 68 of the clamp 66 against the shoulder 58 of the screw 52. In turn, the arms 70, 72, and 76 of the clip 66 are then urged against the stretcher frame 10 to clamp the stretcher frame 10 against the frame 30. The arms of the clip provide a bias in two directions to urge the stretcher frame 10, both against the frame 30 and along the frame 30, as discussed above.

FIG. 4 is a perspective view of a clamp apparatus 110, which is an alternate embodiment of the canvas frame spring tension wire clamp apparatus 50 discussed above in conjunction with FIGS. 1-3. The clamp apparatus 110 of FIG. 4 is of the same general type and employs the same philosophy as the clamp apparatus 50. However, it is used with a different type of decorative picture frame, which will be discussed below in conjunction with FIGS. 5, 6, and 7.

FIG. 5 is a top view of a picture frame 90, with the canvas picture frame 10 discussed above in conjunction with FIGS. 2 and 3, disposed in the decorative picture frame 90. The clamp apparatus 110 is secured to the frame 90 to hold the stretcher frame 10 to the frame 90. FIG. 6 is a view in partial section of the apparatus of FIG. 5, generally taken along line 6—6 of FIG. 5. FIG. 7 is a view in partial section of a portion of the apparatus of FIG. 5, taken generally along line 7—7 of FIG. 5. For the following discussion of the clamp apparatus 110, and its use in securing the stretcher frame 10 to the decorative frame 90, reference will be made to FIGS. 4, 5, 6, and 7.

The clamp apparatus 110 is substantially identical to the clamp apparatus 50, discussed above, except that the clamp 110 employs a clip 126 which is of a slightly different configuration than the clip 66 of the clamp 50, but still provides a two direction biasing action. The clamp 110 includes a screw 112, which is illustrated as being a flat headed wood screw. The screw 112 includes a head 114 which is generally flat or planar on the top and which includes a slot 116. The slot 116 receives a screwdriver blade for securing the screw 112 to the wooden frame 90. A sloping shoulder 118 extends downwardly and inwardly from the outer periphery of the head 114 and joins a threaded shank 120. The threaded shank 120 extends downwardly from the head 112 and terminates in a pointed tip.

A spacer 122, which is substantially identical to the spacer 62 of clamp 50, is disposed about the threaded shank 120 of the screw 112. The purpose of the spacer 122 is substantially identical in all respects to the spacer 62, discussed in detail above. The spacer 122 includes a plurality of coils 124 which extend helically about the threaded shank 120 of the screw 112. The coils 124 are preferably initially spaced apart, as shown in FIG. 4 (see also FIG. 1), and the spacing may then be adjusted to provide the desired spacing and tension against the clip 126. The spacer 122 biases the clip 126 against the head 112. The spacer coils may be spread apart, or the overall length of the spacer may be shortened by cutting off material, etc., as desired or necessary.

The clip 126 includes a circular eye 128 which extends about the shank 120 of the screw 112. Extending outwardly from the eye 128 in an extension arm 130. The extension arm 130 includes an intermediate arm 132 extending at a slight obtuse angle from the arm 130. The arm 132 is connected to a lateral arm 134 which extends substantially perpendicularly to the arm 132. The arms 132 and 134 comprise a pair of side or intermediate arms. As best shown in FIG. 5, the arms 132 and 134 are disposed against the back of the frame 10, and on the canvas fold 20. The arms 132 and 134 provide a force to bias the stretcher frame 10 against or toward the decorative frame 90. The lengths of the arms 132 and 134 are both substantially less than the overall length of the arm 130. The lengths of the arms 132 and 134 may be relatively short, and are of nearly the same length.

Finally, at the end of the arm 134, remote from the arm 132, is an outer arm 136. The outer arm 136 may extend generally parallel to the arm 130, or it is disposed in a plane substantially parallel to the plane of the arm 130 and the eye 128. The outer arm 136 provides a lateral bias against the stretcher frame 10 to bias the stretcher frame away inwardly towards the center of the frame 90.

The stretcher frame 10, illustrated in FIGS. 5, 6, and 7, is substantially identical to the stretcher frame 10 of FIGS. 2 and 3, and discussed above in detail. The stretcher frame 10 is disposed within the decorative frame 90. The frame 90 is somewhat of a different design than the frame 30 of FIGS. 2 and 3. The frame 90 includes a pair of arms 92 and 98, secured together and appropriately mitered for assembly purposes. As is obvious, only a portion, namely one corner, of frame 90 is shown. The corner portion shown includes only parts of the two arms 92 and 98. The other two arms of the frame 90 are not shown. While the frame 90 may be square or rectangular, having four sides, it is obvious that any other configuration of frame may be used. The design of the decorative or outer picture frame used in conjunction with a particular stretcher frame will, of course, match the general configuration of the stretcher frame.

The clamp apparatus of the present invention is designed to be employed without regard to the particular design or configuration of the picture frames, the distinction between the picture frames 30 and 90 being in the thickness, or in the distance from the front of the picture frame to the rear of the picture frame, with respect to the canvas stretcher frame 10. This dintinction is best shown in FIG. 6, and may be contrasted for comparative purposes with FIG. 3.

The sides or arms 92 and 98 include rabbeted grooves on the inner periphery of the arms on which the stretcher frame 10 is disposed. The rabbeted grooves include, for the side or arm 92, a flange 94 and a side 96, and for the arm 98 a flange 100 and a side 102. The stretcher frame 10 is disposed on the flanges 94 and 100. As illustrated in FIGS. 5 and 6, the outer peripheral sides 26 and 28 of the stretcher frame arms 12 and 14, respectively, are spaced apart slightly from the side 96 and 102 of the arms 92 and 98, respectively.

The primary difference between the frame 90 and the frame 30 is best illustrated in FIG. 6, in which the frame 10 is shown recessed within the frame 90. This may be compared to FIG. 3 in which the frame is shown extending above the back surface 44 of the frame 30. The back or rear of the frame 90 includes a generally flat or planar rear surface 104 on the arm 98. The frame 10 is downwardly, within the frame 90, from the surface 104. The frame 90 also includes a front surface or face 106. The flat or planar back surface 104 compares to the generally flat, planar back or rear surface 44 of the frame 30, while the front surface or face 106 of the frame 90 compares to the front surface or face 46 of the frame 30. It will be noted, from comparing FIGS. 3 and 6, that the distance between the front surface 106 and the rear surface 104 of the frame 90 is substantially greater than the distance between the front surface 46 and the rear surface 44 of the frame 30. Thus the frame 90 is a much deeper or thicker frame than the frame 30. The distance between the flange 100 on which the canvas stretcher frame 110 is disposed and the rear surface 104 is substantially greater than the overall thickness of the stretcher frame 10. Accordingly, the stretcher frame 10 is disposed within the frame 90, and does not extend outwardly or beyond the rear surface of the frame 90, as does the stretcher frame 10 with respect to the frame 30. For securing the stretcher frame 10 to the frame 90, the clamp apparatus 110 is used.

The clamp apparatus 110 is used to secure the stretcher frame 10 to the frame 90 by disposing the arms 132 and 134 against a back or rear surface of the frame 10, with the arms 132 and 134 disposed on the canvas fold 20. The arm 136 of the clip 126 is disposed against the side 28 of the stretcher frame 10.

The screw 112 of the clamp 110 is shown extending into the side arm 98 of the frame 90 through the side 102. The screw 112 is, of course, spaced downwardly from the rear surface 104 of the arm 98, which is part of the back of the frame 90. The screw 120 is screwed into the arm 98, substantially as described above with respect to the screw 52. The spacer 122 is adjusted lengthwise to provide sufficient bias to hold the clip 126 securely against the stretcher frame 10, all as discussed above in conjunction with the clamp 50 and its clip 66.

The arms 132 and 134 provide, in conjunction with the screw 122 and the clip 126, a bias through the extension arm 130 to hold the stretcher frame 10 against the flange 100. At the same time, the arm 136 provides, again through the clip 126 and the spacer 122 and screw 112, a lateral bias against the stretcher frame 110 by acting against the side 28 of the frame 10. The term "lateral" with respect to the biasing action of the arm 136 is used to denote a force substantially perpendicular to the force or bias of the arms 132 and 134, and which force or bias by the arm 136 acts against the stretcher frame 10 away from the side 102 and either against the opposite side of the frame 90 (not shown), substantially parallel to the side 102, or else against a like clamp 110 (not shown) disposed into an opposite side of the frame 90 substantially parallel to the arm 98 (not shown).

The biasing action of the arms 132 and 134 of the clamp 110 is substantially the same as the biasing action of the arms 70 and 72 of the clamp 50, and the biasing action of the the arm 136 is substantially the same as the biasing action of the arm 76 of the clamp 50. Thus, while the design of the clips 66 and 126 are slightly different in overall configuration, they provide substantially the same double biasing forces with respect to the decorative frames and to the stretcher frames that the clips are secured to and against. The primary distinction between the two clips is in their application to a particular decorative picture frame, with their configurations being altered accordingly.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Clamp apparatus for securing a canvas stretching frame to a decorative frame, comprising, in combination:

screw means, including a shank, including a threaded portion for securing to the decorative frame, and a head adjacent the threaded shank; clip means secured to the screw means, including an extension arm extending from the screw means to the decorative frame, intermediate arm means connected to the extension arm and disposed on the stretcher frame for biasing the stretcher frame against the decorative picture frame, and an outer arm connected to the intermediate arm means and disposed on the stretcher frame for biasing the stretcher frame in a direction substantially perpendicular to the direction of bias of the intermediate arm means.

2. The apparatus of claim 1 in which the screw means further includes spacer means for biasing the clip means against the head of the screw means.

3. The apparatus of claim 1 in which the clip means includes means for securing the extension arm to the screw means.

4. The apparatus of claim 3 in which the means for securing the extension arm to the screw means includes an eye secured to the extension arm and disposed about the shank of the screw means.

5. The apparatus of claim 4 in which the screw means further includes spacer means disposed about the shank for biasing the eye of the clip means against the head.

6. The apparatus of claim 5 in which the head of the screw means includes a shoulder adjacent the shank, and the spacer means biases the eye against the shoulder.

7. The apparatus of claim 1 in which the intermediate arm means comprises an intermediate arm connected to the extension arm and to the outer arm.

8. The apparatus of claim 7 in which the intermediate arm and the extension arm are disposed in a common plane and both are adapted to be disposed against the stretcher frame.

9. The apparatus of claim 7 in which the intermediate arm is connected to the extension arm at an acute included angle.

10. The apparatus of claim 1 in which the intermediate arm means comprises a first arm and a second arm defining a plane, and connected together, and the first arm is connected to the extension arm and the second arm is connected to the outer arm.

* * * * *